United States Patent [19]

Henes

[11] 4,425,215

[45] Jan. 10, 1984

[54] GAS GENERATOR

[75] Inventor: Richard W. Henes, Phoenix, Ariz.

[73] Assignee: Henes Products Corp., Phoenix, Ariz.

[21] Appl. No.: 423,637

[22] Filed: Sep. 27, 1982

[51] Int. Cl.[3] ..... C25B 9/00; C25B 15/08

[52] U.S. Cl. ..... 204/258; 204/270; 204/278

[58] Field of Search ..... 204/275-278, 204/279, 266, 256, 258, 269-270, 255, 257, 263-265

[56] References Cited

U.S. PATENT DOCUMENTS

| | | | |
|---|---|---|---|
| 3,451,906 | 6/1969 | Weed | 204/82 |
| 3,489,614 | 1/1970 | Tomter | 204/256 X |
| 3,518,180 | 6/1970 | Grotheer | 204/268 |
| 3,616,436 | 10/1971 | Haas | 204/229 |
| 3,824,172 | 7/1974 | Hodges | 204/269 |
| 3,957,618 | 5/1976 | Spirig | 204/270 |
| 3,990,962 | 11/1976 | Gotz | 204/268 |
| 3,994,798 | 11/1976 | Westerlund | 204/268 |
| 4,014,777 | 3/1977 | Brown | 204/270 |
| 4,124,480 | 11/1978 | Stevenson | 204/268 |
| 4,131,532 | 12/1978 | Chillier-Duchatel et al. | 204/258 X |
| 4,206,029 | 6/1980 | Spirig | 204/228 |
| 4,233,146 | 11/1980 | Rothmayer et al. | 204/279 X |
| 4,323,444 | 4/1982 | Kawamura et al. | 204/269 |
| 4,339,324 | 7/1982 | Haas | 204/270 |
| 4,358,357 | 11/1982 | Pere | 204/258 X |

FOREIGN PATENT DOCUMENTS

| | | | |
|---|---|---|---|
| 2101569 | 7/1972 | Fed. Rep. of Germany | 204/263 |

*Primary Examiner*—Donald R. Valentine
*Attorney, Agent, or Firm*—Warren F. B. Lindsley

[57] ABSTRACT

A gas generator assembly comprising a three plate cell employable in a series of cells to form a generator having a minimum number of parts.

6 Claims, 10 Drawing Figures

50
52
53
54
55
56
57
58
59
60
61
62

GAS GENERATOR

BACKGROUND OF THE INVENTION

This invention relates to electrolysis and more particularly to the electrolysis of water for the generation of oxygen and hydrogen.

Electrolysis is a process in which an electric current is passed through a liquid causing a chemical reaction to take place. If the liquid is water, electrolysis "breaks up" the water into two gases, namely oxygen and hydrogen. In the electrolysis of water, the hydrogen gas collects at the cathode electrode and the oxygen gas collects at the anode electrode of the gas generator. Because pure water is not a suitable conductor of electricity, a conductor such as potassium hydroxide is added to the water to form an electrically conductive solution. Such a solution is known as an electrolyte. This process generates gas as a function of the surface area of the anode and cathode electrodes in contact with the electrolyte and directly proportional to the amount of current flowing through the gas generator.

One practical use of the gas produced by this means is as a fuel for welding equipment. In this type of application, the proportions of oxygen and hydrogen produced by electrolysis (one part oxygen or two parts hydrogen commonly referred to as oxyhydrogen when combined) exactly matches the proportions needed for recombination (combustion) in the flame of an associated welding torch. Other uses of the invention are employed in discrete gas generation where the oxygen and hydrogen gases are separated and useable independently of each other.

DESCRIPTION OF THE PRIOR ART

Present day apparatus in use for generating oxygen and hydrogen gases are generally very bulky and inefficient devices. Because of their poor operating characteristics, they have not been ideally suited for use in mobile or portable equipment.

Although many patents have issued over the years directed to electrolysis equipment, none have developed an efficient compact gas generating cell for use in polycell gas generators.

U.S. Pat. No. 3,616,436 discloses a single pair of anode and cathode electrodes in a single electrolytic cell for the production of oxygen.

U.S. Pat. No. 3,451,906 discloses a multi-cell apparatus for the production of halates, perhalates or hypohalates of alkali metals.

U.S. Pat. No. 3,518,180 describes a bipolar electrolytic cell and an assembly comprising a multiplicity of such cells for use in producing chlorates and perchlorates.

U.S. Pat. No. 3,824,172 describes an electrolytic cell for the production of alkali metal chlorates.

U.S. Pat. Nos. 3,957,618; 3,990,962; 4,014,777 and 4,206,029 describe further apparatus for the generation of detonating gas.

U.S. Pat. No. 3,994,798 describes an electrode assembly for use in multi-cell electrolysis apparatus.

U.S. Pat. No. 4,124,480 describes a bipolar cell for use primarily in the manufacture of sodium hypochlorite.

U.S. Pat. No. 4,339,324 discloses a gas generator comprising a multiplicity of electrolytic cells arranged to accommodate a series current path, parallel electrolytic flow and minimized leakage current paths, in a staked plate configuration that affords a high degree of portability at low cost.

U.S. patent application Ser. No. 297,946, entitled "Polycell Gas Generator Employing Gas Lift Pump Arrangement", filed Aug. 31, 1981 by applicant and assigned to the assignee of this application, discloses a polycell gas generator employing a stack configuration having a gas and electrolyte separating tank arranged above the gas generator such that a continuous electrolyte flow occurs between tank and gas generator by the effect of the buoyance of the gas generated in the gas generator.

U.S. patent application, Ser. No. 314,255, entitled "Gas Generating Apparatus", filed Oct. 23, 1981 by Robert M. Hansen and assigned to the assignee of this application, discloses an electrolytic cell in combination with a variable voltage source. A vernier control of cell current is effected through the use of a voltage source that has a fixed voltage portion and a variable portion wherein the fixed portion and the range of the variable portion are related to the volt-ampere characteristic of the cell.

SUMMARY OF THE INVENTION

In accordance with the invention claimed, a highly efficient gas generator is disclosed utilizing a novel cell configuration that provides a series electrical current path through its cell or cells in combination with parallel electrolyte paths through the cell or cells with the assembly characterized by low cost, portability and a minimum of moving parts.

It is, therefore, one object of the present invention to provide a new and improved electrolytic gas generator.

Another object of this invention is to provide an improved three plate cell for producing oxygen and hydrogen gases.

A further object of the invention is to provide an improved and efficient gas generator assembly employing a series of cells with each cell having a minimum number of parts formed to minimize electrolyte leakage.

A still further object of this invention is to provide a new and improved gas generator wherein the electrolyte passageways have been increased in size over the prior art.

A still further object of this invention is to provide a new and improved gas generator which employs electrodes which in combination with adjacent plastic separating sheets forms a passageway for the electrolyte.

A still further object of this invention is to provide an improved gas generator which separates and discharges separately the generated oxygen and hydrogen gases.

These and other objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings, in which.

DESCRIPTION OF THE PREFERRED EMBODIMENT

Figure 1:
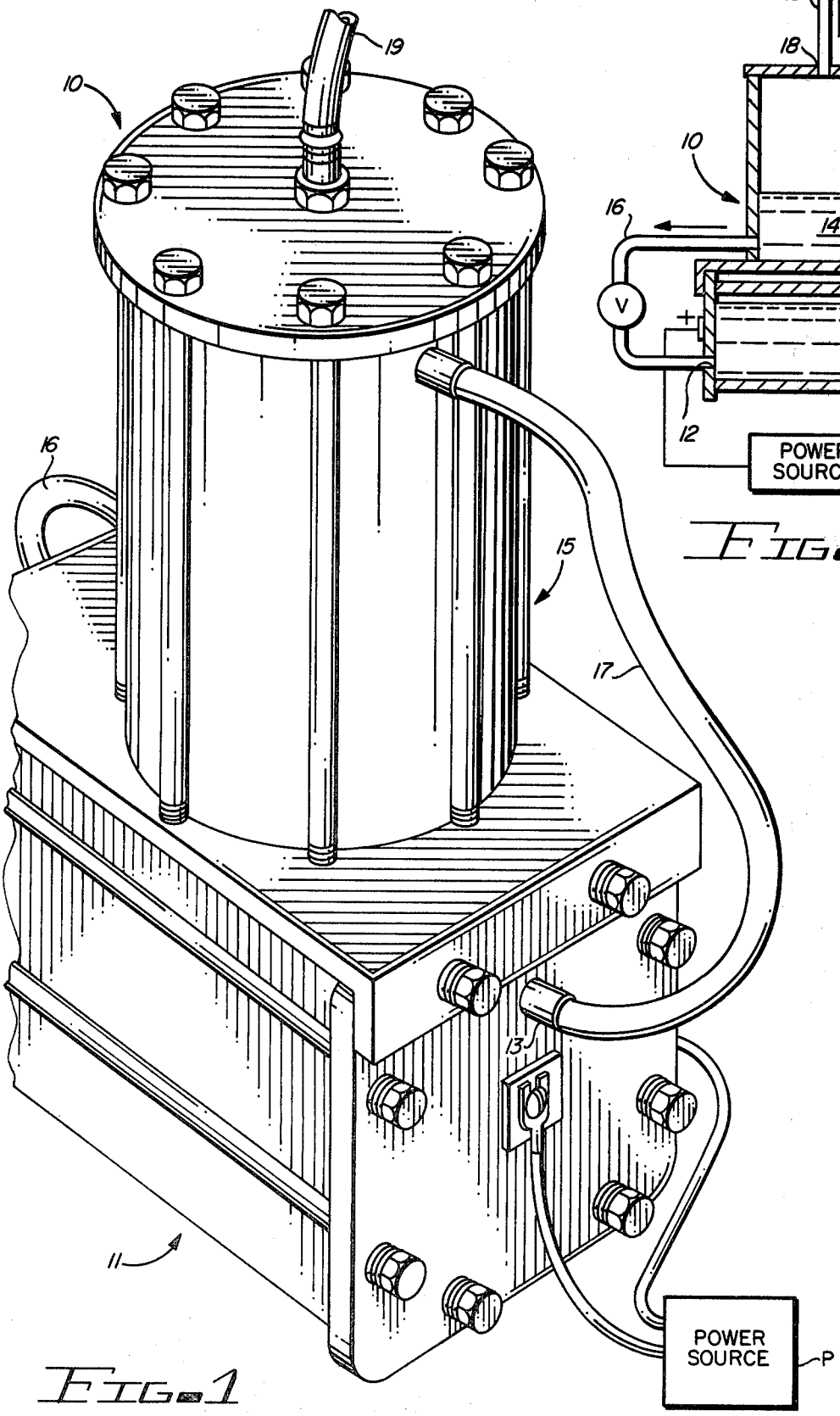
FIG. 1 is a partial perspective view of an improved gas generator embodying the invention.
Figure 2:
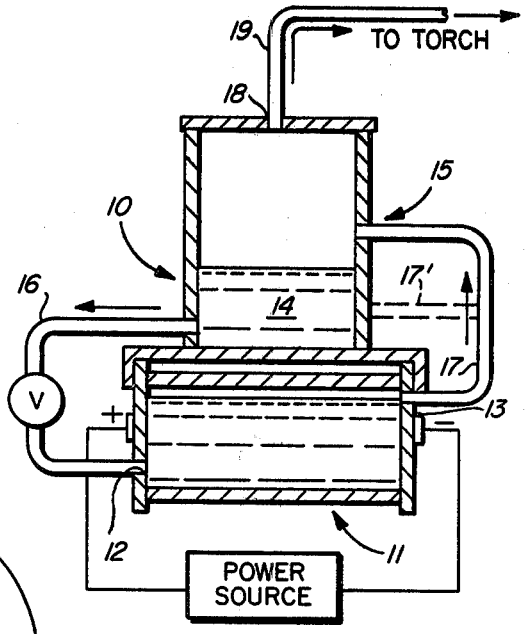
FIG. 2 is a simplified functional diagram of the gas generator shown in FIG. 1.

Referring more particularly to the drawings by characters of reference, FIGS. 1 and 2 disclose a gas generator assembly 10 comprising an electrolysis chamber or generator 11 having inlet and outlet ports 12 and 13, respectively. The inlet port 12 comprising one or two port openings, is supplied with electrolyte 14 from a tank 15 mounted above chamber 11 through a pipe line 16 connected to tank 15 near its bottom. The outlet port 13 comprising one or more port openings of chamber 11 is connected by means of a pipe line 17 to tank 15 at a suitable point in the tank. An outlet port 18 at the top of tank 15 is connected by means of a pipe line 19 to a suitable torch (not shown). Chamber 11 is electrically connected across a suitable source of power P as shown in FIGS. 1 and 2.

Figure 3:
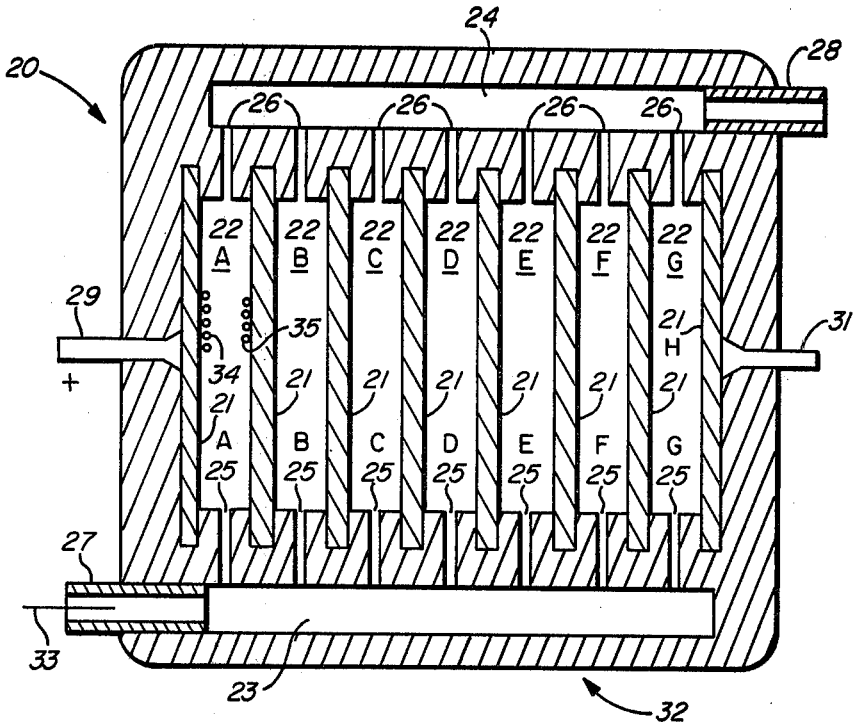
FIG. 3 is a simplified functional diagram of the gas generator portion of the structure shown in FIG. 1.

FIG. 3 discloses a simplified diagram of an electrolysis chamber or polycell gas generator 20 functional in gas generator assembly 10 and comprising parallel, spaced apart plate electrodes 21A–21H, electrolysis chambers 22A–22G, an electrolyte inlet manifold 23, a gas and electrolyte outlet manifold 24, inlet ports 25, outlet ports 26, an electrolyte supply port 27, a gas and electrolyte delivery port 28, a positive terminal 29 and a negative terminal 31. Generator 20 is enclosed in a sealed and electrically insulated housing 32 forming a cavity within which the chambers 22A–22G are formed.

In the particular implementation of generator 20 that is of primary interest to this invention, the generator is employed in the electrolysis of water for the generation of oxyhydrogen gas. The electrolyte employed can be a solution of potassium hydroxide (KOH) and distilled water, the potassium hydroxide being employed to provide electrical conductivity. The electrodes 21A–21H are flat rectangular plates which may be made from nickel sheet stock.

In the operation of generator 20, electrolyte 33 enters port 27 and fills inlet manifold 23. From manifold 23, the electrolyte enters chambers 22A–22G via the inlet ports 25, filling chambers 22A–22G and then passes out through the outlet ports 26 into the outlet manifold 24 from which it is finally exhausted through port 28. It will be immediately recognized that the chambers 22A–22G with their inlet ports 25 and their outlet ports 26 constitute parallel flow paths between the inlet manifold 23 and the outlet manifold 24. The manifolds 23 and 24 are sufficiently large in cross-section to assure minimal pressure drops along their lengths. In addition, the entry port 27 is located at the bottom of generator 20 while the delivery port 28 is located at the top of generator 20 so that the total path length traversed by the electrolyte passing through any one of the several chambers 22A–22G is the same as that traversed by the electrolyte passing through any of the remaining chambers. These precautions help assure that the electrolyte is delivered to all the chambers at the same pressure and that the flow rate through all the chambers is the same.

Electric current flow is from the positive terminal 29 to electrode 21A, through the electrolyte in chamber 22A to electrode 21B, from electrode 21B through chamber 22B to electrode 21C, through chamber 22C to electrode 21D, through chamber 22D to electrode 21E, through chamber 22E to electrode 21F through chamber 22F to electrode 21G, through chamber 22G to electrode 21H to negative terminal 31. The electrical conductivity of the electrodes 21A–21H is high so that the potential difference between adjacent electrodes 21A and 21B, 21B and 21C, etc. is uniform over their mutually confronting surfaces. Current density from electrode to electrode through the intervening electrolyte is very uniform because the electrolyte is equally available to each electrode.

Within each of the chambers 22A–22G, current flows from the more positive electrode to the more negative electrode. Thus, the face of the plate electrode from which the current flows serves as the anode for that chamber while the face of the other juxtapositioned plate electrode to which the current flows becomes the cathode. It will be recognized that the opposite face of the electrode serving as a cathode for chamber 22A serves as the anode for chamber 22B. The electrode 21B and the electrodes 21C–21G are thus known as bipolar electrodes, each having one face employed as an anode and the opposite face as a cathode. Within each chamber the current flowing from anode to cathode results in the generation of oxygen and hydrogen, the oxygen 34 collecting at the anode and the hydrogen 35 collecting at the cathode are swept out of the chamber mainly by gravity, assisted by the electrolyte flowing through the chamber, the gas and electrolyte mixture passing through the outlet port 26 of each chamber into the outlet manifold 24 and thence through outlet port 28 to a collection chamber or tank (as shown in FIGS. 1 and 2).

Figure 4:
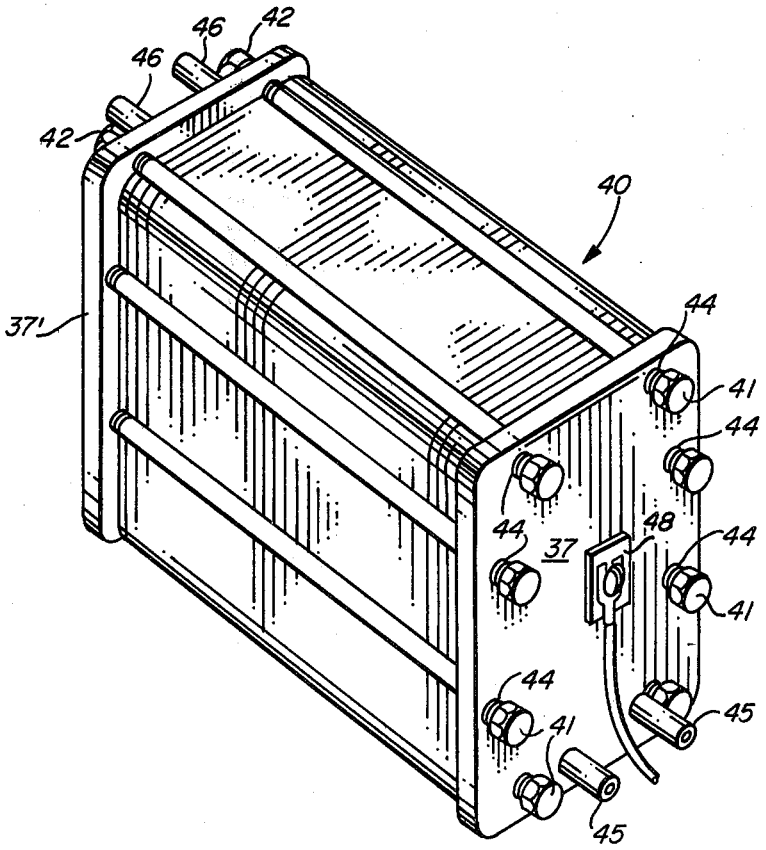
FIG. 4 is a perspective view of a discrete gas generator.

Gas generator 40 of FIG. 4 constitutes another embodiment of the invention and comprises a number of flat or planar elements stacked together between end covers or plates 37, 37′ and secured as a unit by means of bolts 41 and nuts 42.

End covers 37 and 37′ comprise rectangular plates molded from nylon or similar electrically insulating material that is impervious to moisture. Holes provided about its periphery are provided to receive bolts 41. At each end, two electrolyte (or gas and electrolyte) inlet or outlet ports 45 and 46 are provided although in some embodiments only one port at each end may be provided, the ports 45 and 46 being hollow tubular and/or cylindrical configurations with their central openings providing passageways through covers 37, 37′. A screw terminal 48 is provided at the center of each cover with the terminal providing a conductive path through the cover to a contact button (not shown) on the opposite side thereof and also providing a means for connection to the positive or negative terminal of the power supply P. Two such covers are employed in generator 40, one on each end of the stacked planar elements.

Figure 5:
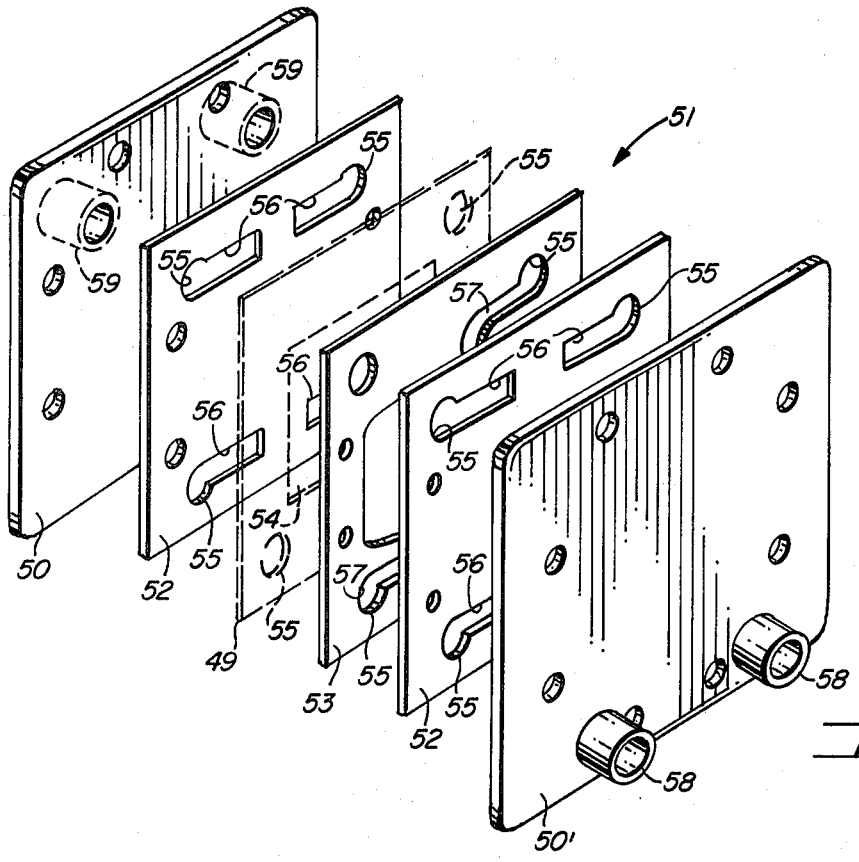
FIG. 5 is a partial exploded view of plates of a single cell gas generator embodying the invention.

FIG. 5, excluding the insulating plate 49 shown in dash lines, illustrates a single cell electrode assembly of a particular cell configuration for a gas generator which may be arranged in multiples between the ends or cover plates 50, 50′ to form a gas generator 51.

Figure 6D:
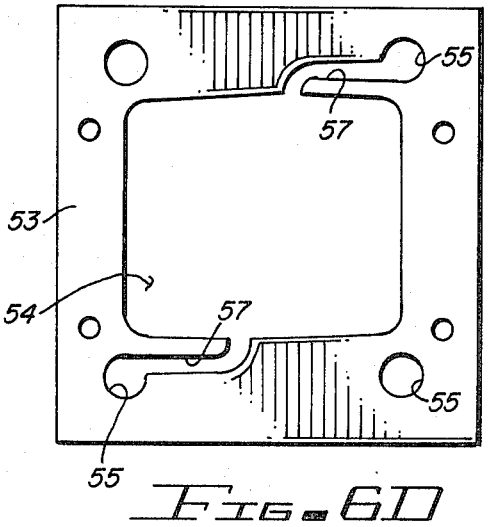
FIGS. 6B–6E are plan views of the various plates shown in FIGS. 5 and 6A.
Figure 6E:
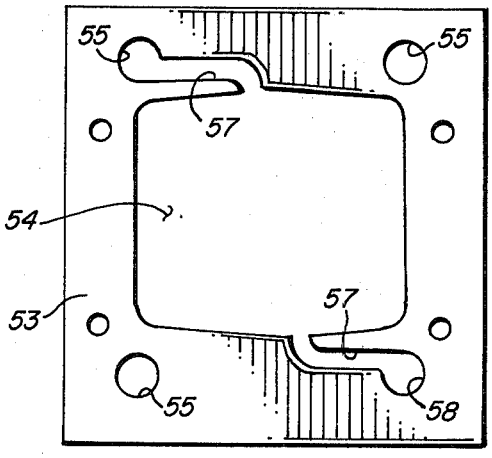
Figures 6A, 6B, 6C:
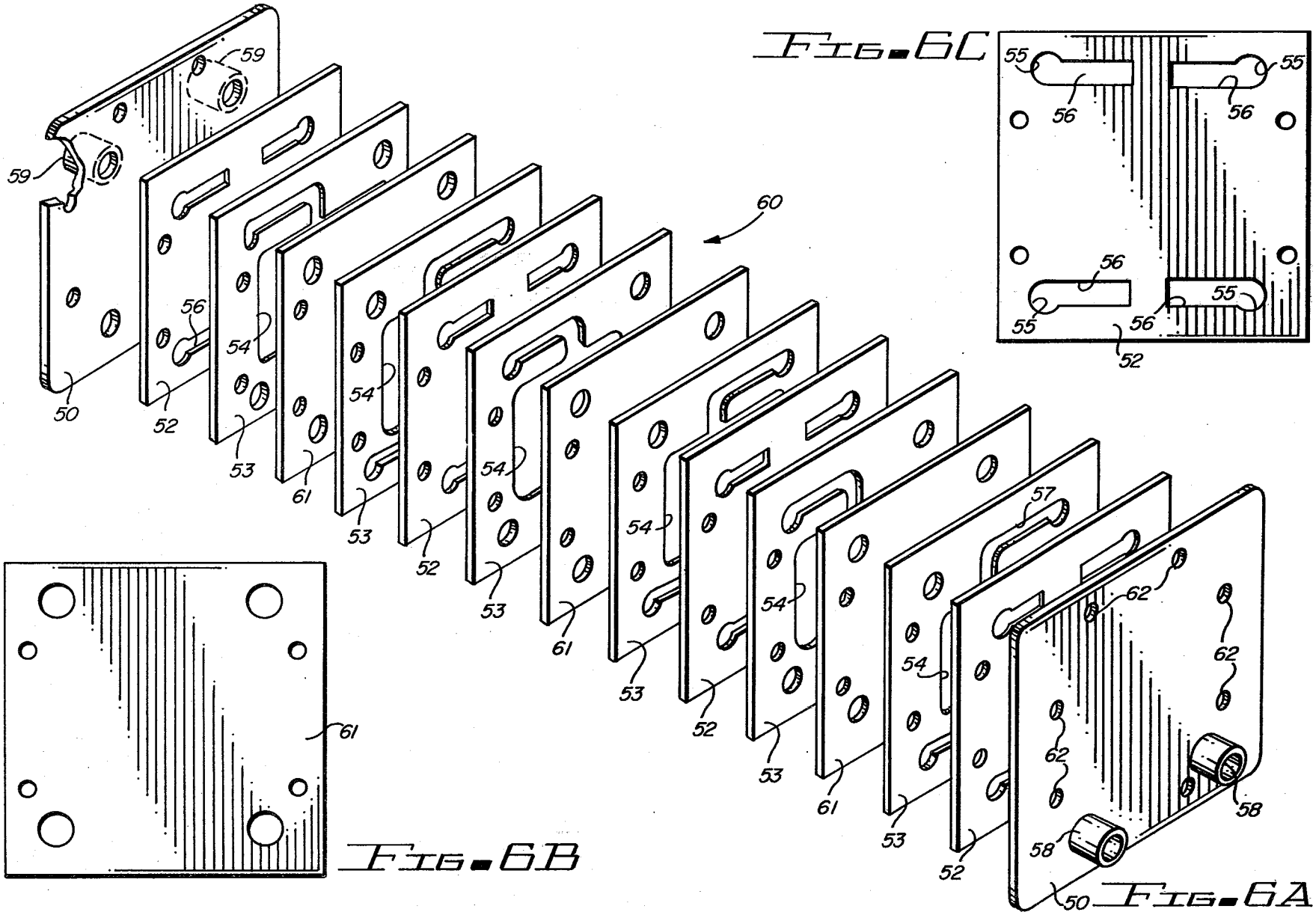
FIG. 6A is a partial view of the plates of a discrete gas generator employing the plates shown in FIG. 5.

Each cell assembly of this gas generator comprises an electrode plate 52, shown more clearly in FIG. 6C, positioned at each end of the cell assembly which is formed of a thin conductive plate of nickel when used in a oxyhydrogen gas generator. An insulating spacer element or plate 53 comprising a frame, as shown in FIGS. 6D and 6E encircling an opening 54 extending therethrough is mounted between the pair of electrodes 52 in an aligned parallel array. Each of the electrodes 52, spacer element 53 and cover plates 50, 50' have opposed end portions. Each electrode plate and spacer element is provided with one or a pair of spaced apertures 55 extending therethrough in each end portion thereof with similarly positioned apertures in each end portion of the electrode plates and spacer elements being interconnected in axial alignment. Each aperture 55 in each electrode plate is provided with a slot 56 extending from that aperture toward the center of the plate and in line with any other aperture of the electrode plate at that end of the plate.

One aperture 55 at each end of the element is provided with a slot 57 extending laterally from the aperture toward a center line of the frame and communicating with opening 54 in the frame.

It should be noted that slots 56 at each end of electrode plates 52 are juxtapositioned to and overlap any slots 57 that appear in juxtapositioned spacer plates 53. The aligned apertures 55 of electrode plates 52 and spacer plate 53 at the lower end portions thereof are connected through inlet ports 58 in cover plate 50' to a source of electrolyte which flows through these inlet ports and apertures into the gas generator.

Electrolyte flowing into inlet port 58 at the left bottom corner of cover plate 50' flows through aperture 55 in plate 52 and into aperture 55 in plate 53 and through slot 57 connected thereto and into the opening 54 in the frame formed by plate 53. After passing through opening 54, which is closed on both sides by the flat adjacent surfaces of adjacent plates 52, the electrolyte and gases generated in this passageway pass through slot 57 and aperture 55 in the top of spacer plate 53 and through outlet ports 59 to a storage tank or torch (not shown).

If desired, an insulating plate or frame, such as plate 49 formed of the same material as plate 53 and having a substantially matching opening 54 therein shown in dash lines in FIG. 5, may be utilized to block each side of the gas generator from passing electric current from the first electrode directly to a later electrode, bypassing one or more intervening electrodes. It should be noted that plate 49 is only used in a multi-cell sequence even though it is shown for purposes of illustration in FIG. 5 in a single embodiment. With plate 49 in place, electrolyte will pass through only the inlet port 58 shown on the left side of cover plate 50', through aperture 55 in plate 52, aperture 55 and slot 57 in plate 53, opening 54 in plate 53, slot 57 and aperture 55 at the top of plate 53, aperture 55 in plate 49, aperture 55 in the plate 52 to the left of plate 49, as shown in FIG. 5, and out of outlet port 59 at the top right side of cover plate 50. Plate 49 merely serves to insulate one cell from another by closing and forming a barrier between slots 56 and slots 57 of the plates in question. An alternate method of accomplishing this is to flip-flop plate 53 for each cell in a generator configuration, but this arrangement then necessitates using both inlet ports 58 at one end and both outlet ports 59 at the other end. The use of plate 49 allows use of only one inlet port 58 and one outlet port 59, and plates 53 are then not flip-flopped for each cell.

FIG. 6A illustrates an electrode assembly of the particular cell configuration shown in FIG. 5 for a discrete gas generator which may be arranged in multiples between the end plates 50 and 50' which cells when stacked and held together by bolts and nuts 41 and 42 of FIG. 4 form a discrete gas generator 51.

Each cell assembly of this discrete gas generator comprises an oxygen generating cell and a hydrogen generating cell. An assembled gas generator comprises an electrode plate 52, as shown in FIG. 6C, positioned at each end of a cell assembly which is formed of nickel when used in an oxyhydrogen gas generator. Terminals at the ends of the stacked assembly may serve as terminals for the gas generator as shown in FIG. 4.

Each cell assembly in gas generator 60 comprises a thin conductive solid plate 52, insulating picture frame-like spacer element or plate 53 of the type shown in FIGS. 6D and 6E, having an enclosed opening 54, separated by a separator element or plate 61, shown in FIG. 6B, which may be formed of cellophane. Each sequentially arranged plate 53 is arranged in a reverse image position or one rotated 180 degrees on its vertical axis from the preceding plate 53.

The outer dimension of plate 52 and the other plates of the cell assemblies are substantially identical and all employ mating substantially identically spaced and positioned holes or apertures 55, which form gas and electrolyte passageways. Identically positioned bolt holes 62 provided in end plates 50, 50' receive bolts 41 in the manner shown in FIG. 4 for holding the assembly of plates together.

As shown in FIGS. 6A and 6E, each of plates 52 are provided with narrow slots 56, one extending inwardly thereof from a different positioned hole 55 formed therein and along the top and bottom edges of the plate ending just short of the other hole at the opposite sides of the plate. Slots 56 serve as gas and electrolyte passageways in the assembled gas generator 60.

In gas generator 60, a plurality of cell assemblies are arranged in an axial arrangement one sequentially following the other. Reading from left to right, the assembly of gas generator 51 comprises an electrode plate 52, spacer plate 53, cellophane separator membrane 61, spacer plate 53 which is a reverse image of the previously mentioned spacer plate, electrode plate 52, spacer plate 53 which is a reverse image of the previous plate 53, cellophane separator membrane 61, spacer plate 53 arranged as a reverse image of the previous plate 53, electrode plate 52, spacer plate 53, arranged as a reverse image of the previous plate 53, cellophane separator membrane 61, spacer plate 53 which is a reverse image of the previous spacer plate and electrode plate 52.

Each additional cell assembly of plates 52, 53 and 61 used in gas generator 60 are repetition of the plates just described in the continuous assembly of cell assemblies left to right in the gas generator plate assembly shown in FIG. 6A.

The interrelationship between the holes 55 and slots 56 in plates 52 and slots 57 in plates 53, cooperate to form the inlet and outlet ports and manifolds for the electrolyte and generator gas. As shown in FIG. 6A, the holes 55 of the plates 52, 53 and 61 are mutually aligned to form common passageways running perpendicularly through the stacked plates. The four holes 55 in each plate form four passageways through the stacked assembly.

The electrolyte ($H_2O+KOH$) enters the two passages 58 at the bottom right end of the gas generator 60 shown in FIG. 6A formed by the aligned holes 55 of the plates 52, 53 and 61. From these two passages, the electrolyte follows slots 56 of electrode plates 52 to indentations or slots 57 of spacer plates 53. Electrolyte reaching indentation or slots 57 of plates 53 on the right side of plate 61, as shown in FIG. 6A at the right end thereof flows upward out of slots 57 into apertures 55 along the far surface of the cell assembly and all like cells discharging electrolyte and gases into this passageway while electrolyte emerging from indentation or slots 57 of plate 53 to the left of plate 61, rises along the near surface of electrode plate 52 positioned to the left of plate 61. If current I flows into electrode plate 52 from cover plate 50' having an electrode 48 thereon into plate 52 in FIG. 6A, it becomes a cathode and the near face of electrode plate 52 to the left of plate 53 becomes an anode. The gas generated at the far surface of plate 52 to the right of plate 53 is hydrogen and the gas generated at the near surface of plate 52 to the left of plate 53 is oxygen. Both gases move upward along with the flow of the electrolyte, the hydrogen finds its way into slot 57 of the spacer plate 53 to the right of plate 61 following slot 57 into the passageway formed by the aligned holes 55 in the upper right-hand corner of the gas generator, and the oxygen generated on the near surface of plate 52 to the left of plate 61 flows into indentation slots 57 of plate 53 to the left of plate 52 through slot 57 in plate 53 into the passageway formed by the aligned holes 55 in the upper left-hand corner of the gas generator.

Slots 57 thus constitute the inlet and outlet ports corresponding to ports 25 and 26 of gas generator 20 of FIG. 3. The long and narrow proportions of slots 57 afford the high electrical impedance needed for the inlet and outlet ports to assure minimization of leakage currents.

The cellophane separator elements 61, shown in FIG. 6A positioned between adjacent plates 53, readily pass the ionic current flow I, but block the lateral flow of the generated gases. Because the successive spacer plates 53 are reversed to stagger the positions of the indentations or notches 57, the oxygen is consistently diverted to the left and the hydrogen is diverted to the right side of the gas generator as described. With the aid of the cellophane separator elements 61, the generated oxygen and hydrogen gases are separated and delivered separately from gas generator 60.

The flow of electrolyte within the window openings 54 of plates 53 is in the form of an electrolyte sheet or bodies of fluid which are quite narrow in width, the thickness being equal to the thickness of these plates which may be readily made as thin as desired. Close electrode spacing is thus achieved in this assembly without exposure to problems involving close mechanical tolerances. Because the adjacent electrodes 52 are closely spaced, the ionic path length is short which promotes conductivity. Furthermore, the close electrode spacing assures a maximum degree of contact between the electrolyte circulated and the electrode surfaces where the gas is generated. Thus, highly efficient and effective gas production is achieved in an assembly that inherently permits the separation of the oxygen and hydrogen gases.

In a totally assembled generator 60, the elements are stacked in the order shown in FIG. 6A. End covers or plates 50, 50' then are positioned one at each end of the stack of plates with the holes 62 of covers or plates 50, 50' being aligned with their holes 62 receiving bolts 41. The ports 58 of the right cover 50' are preferably positioned at the bottom of the assembly, as shown in FIG. 6A, while the ports 59 of the rear cover 50 are positioned at the top (or vice versa), for gravity reasons.

With plates 52, 53 and 61 and the front and rear covers or plates 50', 50 stacked and aligned, as just described, bolts 41 are passed through holes 62 and are secured in place by means of nuts 42. When the nuts are properly tightened, a sealed assembly is achieved in which the frames of the elements are tightly compressed together so that the electrolyte is effectively contained. The containment of the electrolyte may, of course, be enhanced by prior coating of the mating surfaces with a joint compound or sealing material.

Although but a few embodiments of the invention have been illustrated and described, it will be apparent to those skilled in the art that various changes and modifications may be made therein without departing from the spirit of the invention or from the scope of the appended claims.

What is claimed is:

1. A gas generator assembly comprising in combination:

a pair of metal electrodes positioned in an aligned parallel array, an insulating spacer element comprising a frame encircling an opening extending therethrough mounted between said pair of electrodes in said aligned parallel array, cover plates mounted at each end of the assembly of said electrodes and spacer element, each of said electrodes, spacer element and cover plates having opposed end portions, said electrodes and spacer element each being provided with at least one aperture extending through each of said end portions with apertures in like end portions being interconnected in axial alignment, said frame of said spacer element being provided with a first slot extending laterally from said aperture in each of its end portions toward a center line of said frame and communicating with said opening in said frame, a second slot arranged in each of said end portions of said electrodes extending from said aperture toward the center line of said electrodes, said second slot in each of said end portions of the electrodes being juxapositioned to and overlapping said first slot in said element at each end of said electrodes, and said aligned apertures of said electrodes and said spacer element in common end portions at one end of said electrodes and spacer element being connectable to a source of electrolyte which flows through these apertures, said second slot and associated first slot of said spacer element and into the opening in said spacer element between said electrodes and out said second slot and the associated first slot at the other of said common end portions of said spacer element.

2. A gas generator assembly comprising in combination:

a pair of metal electrodes positioned in an aligned parallel array, an insulating spacer element comprising a frame encircling an opening extending therethrough mounted between said pair of electrodes in said aligned parallel array, cover plates mounted at each end of the assembly of said electrodes and spacer element, each of said electrodes, spacer element and cover plates having opposed end portions, said electrodes and spacer element each being provided with a pair of spaced apertures extending therethrough, one pair in each of said end portions with similarly positioned apertures in like end portions being interconnected in axial alignment, said frame of said spacer element being provided with a first slot extending laterally from one of said apertures in each of its end portions toward a center line of said frame and communicating with said opening in said frame, a pair of second slots arranged in each of said end portions of said electrodes extending from the other of said apertures toward the center line of said electrodes, one of said second slots in each of said end portions of said electrodes being juxtapositioned to and overlapping a first slot in said element, and said aligned apertures of said electrodes and said spacer element in common end portions at one end of said electrodes and spacer element being connectable to a source of electrolyte which flows through these apertures, a second slot and associated first slot of said spacer element and into the opening in said spacer element between said electrodes and out said second slot and the associated first slot at the other of said common end portions of said spacer element.

3. The gas generator assembly set forth in claim 2 in further combination with:

an insulating frame mounted between said electrodes, said insulating frame having an aperture at each end in alignment with said apertures in said end portions of said electrodes and said spacer elements.

4. A polycell gas generator assembly comprising in combination:

a plurality of metal electrodes positioned in an aligned parallel array, a plurality of insulating spacer elements, each comprising a frame encircling an opening extending therethrough, with at least one element mounted between each pair of adjacent electrodes in said aligned parallel array, cover plates mounted at each end of the assembly of said electrodes and spacer elements, each of said electrodes, spacer elements and cover plates having opposed end portions, means for clamping the plurality of electrodes, spacer elements and cover plates together so as to provide a plurality of cells, one between each pair of adjacent electrodes, said electrodes and spacer elements each being provided with a pair of spaced apertures extending therethrough in each of said end portions thereof, each frame of said elements being provided with first slots extending from said apertures at opposite end portions of said elements toward a center line of said frame and communicating with said opening in said frame, a pair of second slots arranged in each electrode in each end portion thereof with each second slot extending laterally from each aperture toward the center line of said frame, one of said second slots in each end portion of the electrode being juxtapositioned to and overlapping said first slot in an adjacent element in that end portion of said electrode, and the aligned apertures in one end portion of said electrodes and spacer elements being connectable to a source of electrolyte which flows through these apertures, the second slots of said electrodes and associated first slots of said spacer elements into the opening in said spacer elements between said electrodes in a parallel simultaneous manner and out the first slots and associated second slots of the electrodes at the other end portion of said electrodes and spacer elements.

5. A gas generator assembly comprising in combination:

a pair of flat metal electrodes positioned in an aligned parallel array, a pair of insulating spacer elements comprising frames encircling openings extending therethrough mounted between said pair of electrodes in said aligned parallel array, a semipermeable membrane element comprising a substantial gas barrier mounted between said pair of insulating spacer elements, each of said electrodes, spacer elements and membrane element having opposed end portions, said electrodes, spacer elements and membrane element each being provided with a pair of spaced apertures extending therethrough in each of said end portions with similarly positioned apertures in like end portions being interconnected in axial alignment, a pair of first slots arranged in said end portions of said electrodes extending from said apertures toward the center of said electrodes, each frame of said spacer elements being provided with a second slot extending laterally from one of said apertures in each of said end portions of said elements toward the center of said frame and communicating with said opening in said frame, one of said first slots in each of said end portions of said electrodes being juxtapositioned to and overlapping a second slot in said spacer element, and each spacer element being a reverse image of the next spacer element in the array, said aligned apertures of said electrodes, said spacer elements and said membrane element in common end portions at one end thereof being connectable to a source of electrolyte which flows through these apertures, a first slot and associated second slot of each said spacer element and into the opening in each said spacer element between one of said electrodes and said membrane element and out said first slot and second slot at the other of said end portions of each said spacer element, said aligned apertures of said electrodes, said spacer elements and said membrane element in common end portions at one end thereof serving as gas discharge ports.

6. A gas generator assembly comprising in combination:

a plurality of flat metal electrodes positioned in an aligned parallel array, a plurality of insulating spacer elements comprising frames encircling openings extending therethrough mounted between each pair of electrodes in said aligned parallel array, a semipermeable membrane element comprising a substantial gas barrier mounted between each pair of insulating spacer elements, each of said electrodes, spacer elements and membrane elements having opposed end portions, said electrodes, spacer elements and membrane elements each being provided with a pair of spaced apertures extending therethrough in each of said end portions with similarly positioned apertures in like end portions being interconnected in axial alignment, a pair of first slots arranged in said end portions of said electrodes extending from said apertures toward the center of said electrodes, each frame of said spacer elements being provided with a second slot extending laterally from one of said apertures in each of said end portions of said elements toward the center of said frame and communicating with said opening in said frame, one of said first slots in each of said end portions of said electrodes being juxtapositioned to and overlapping a second slot in each spacer element, and each spacer element being a reverse image of the next spacer element in the array, said aligned apertures of said electrodes, said spacer elements and said membrane elements in common end portions at one end thereof being connectable to a source of electrolyte which flows through these apertures, a first slot and associated second slot of each said spacer element and into the opening in each said spacer element between one of said electrodes and said membrane elements and out said first slot and second slot at the other of said end portions of each said spacer elements, said aligned apertures of said electrodes, said spacer elements and said membrane elements in common end portions at one end thereof serving as gas discharge ports.

* * * * *